US006825792B1

(12) United States Patent
Letovsky

(10) Patent No.: US 6,825,792 B1
(45) Date of Patent: Nov. 30, 2004

(54) MISSILE DETECTION AND NEUTRALIZATION SYSTEM

(76) Inventor: Howard Letovsky, P.O. Box 1925, Willits, CA (US) 95490

( * ) Notice: Subject to any disclaimer, the term of this patent is extended or adjusted under 35 U.S.C. 154(b) by 29 days.

(21) Appl. No.: 10/680,779

(22) Filed: Oct. 6, 2003

(51) Int. Cl.[7] ..... G01S 13/88; G01S 13/66; H05H 3/00

(52) U.S. Cl. ..... 342/14; 342/13; 342/26 R; 342/52; 342/89; 342/90; 342/175; 342/195; 342/450; 342/451; 89/1.11; 250/251

(58) Field of Search ..... 342/13–20, 27, 342/28, 52–59, 89–103, 175, 195, 351, 352, 450–465, 26, 26 R, 26 A, 26 B, 26 C, 26 D; 89/1.11; 244/3.1–3.3; 356/311; 361/156; 250/214.1, 349, 339.14, 358.1, 342, 251, 306–311, 441.11, 442.11, 440.11, 443.1, 396 R, 397–400, 396 ML, 423 R, 424–427, 423 P, 423 F

(56) References Cited

U.S. PATENT DOCUMENTS

| | | | | | |
|---|---|---|---|---|---|
| 3,061,727 | A | * | 10/1962 | Roth et al. | 250/349 |
| 3,160,795 | A | * | 12/1964 | Aune | 361/156 |
| 3,320,420 | A | * | 5/1967 | Paglee et al. | 250/342 |
| 3,727,225 | A | * | 4/1973 | Adrian | 342/460 |
| 3,848,129 | A | * | 11/1974 | Figler et al. | 250/339.14 |
| 3,971,292 | A | | 7/1976 | Paniagua | |
| 3,982,713 | A | * | 9/1976 | Martin | 244/3.1 |
| 5,053,622 | A | * | 10/1991 | Kessler | 250/358.1 |
| 5,157,401 | A | * | 10/1992 | Doucet | 342/14 |
| 5,198,607 | A | * | 3/1993 | Livingston et al. | 89/1.11 |
| 5,340,056 | A | | 8/1994 | Guelman et al. | |
| 5,361,069 | A | * | 11/1994 | Klimek et al. | 342/20 |
| 5,400,688 | A | * | 3/1995 | Eninger et al. | 89/1.11 |
| 5,428,221 | A | * | 6/1995 | Bushman | 250/342 |
| 5,464,174 | A | | 11/1995 | Lauren | |
| 5,625,525 | A | | 4/1997 | Coakley et al. | |
| 5,757,310 | A | * | 5/1998 | Millward | 342/95 |
| 5,828,334 | A | * | 10/1998 | Deegan | 342/90 |
| 5,850,285 | A | * | 12/1998 | Hill et al. | 356/311 |
| 6,232,922 | B1 | | 5/2001 | McIntosh | |
| 6,278,945 | B1 | | 8/2001 | Lin | |
| 6,527,221 | B1 | | 3/2003 | Kremeyer | |
| 6,527,222 | B1 | * | 3/2003 | Redano | 244/3.14 |
| 6,677,571 | B1 | * | 1/2004 | Clark et al. | 250/214.1 |

* cited by examiner

*Primary Examiner*—Bernarr E. Gregory

(57) ABSTRACT

The present invention is intended to provide a system for determining the precise launch point of ballistic missiles, and may additionally provide the capability of neutralizing said threats. The invention provides a mobile object information means configured to classify electromagnetic frequency activity within satellite and land based commercial and private broadcast and telecommunications spectra in a given geographical area, said means also configured to classify associated area weather normality and anomalies. The system includes a software algorithm configured to extract from said database, a missile launch in a given geographical zone by "tagging" an electromagnetic wave disturbance caused by the high intensity initial fuel burn of said missile launch. Additionally, the system is intended to affect the electrical functioning of a missile guidance system or warhead detonator by transmitting a precisely tuned frequency wave combination from a defensive missile borne frequency generator, or from a network of satellite or land based transmitters.

9 Claims, 1 Drawing Sheet

MISSILE DETECTION AND NEUTRALIZATION SYSTEM

BACKGROUND

Field of Invention

The present invention relates generally to apparatus and processes that detect the launching of a missile or other high speed, propellant or electromagnetically fired projectile, pinpoint the geographical location of said launch, determine the trajectory of said missile, and destroy said missile.

BACKGROUND

Description of Prior Art

Various Anti-Ballistic Missile systems have been developed that determine the launch position and trajectory of a propellant fired missile. These include AN/SPY series radar system of the type deployed on U.S. Navy Aegis cruisers. Additional GPS related missile tracking systems are disclosed in U.S. Pat. No. 6,278,945 to Lin, and U.S. Pat. No. 6,232,922 to McIntosh.

Prior art ABM systems using trajectory trisection technology such as disclosed in Millard's U.S. Pat. No. 5,757,310, offer the benefit that significant time is available to track the incoming ballistic missiles, calculate their trajectory, and distinguish decoys from actual ballistic missiles. However, one of the major drawbacks of such a system is that the incoming ballistic missile is relatively close to its target by the time such an ABM system can launch an interceptor missile. If the interceptor missile misses or experiences a malfunction, inadequate time is left to take alternate defensive measures. Such drawbacks are discussed in U.S. Pat. No. 5,340,056 to Guelman et al. Other antiballistic missile technology is disclosed in U.S. Pat. No. 5,464,174 to Lauren. Additionally, Redano's U.S. Pat. No. 6,527,222 discloses a mobile, ship based ballistic missile detection and defense system intended to be deployed in the vicinity of rogue nations which may pose a ballistic missile threat to the United States.

These prior art missile tracking and anti-ballistic missile defense systems may be moderately useful for defending against localized, small scale ballistic missile attacks, but in the event of a wide area, multiple missile assault, no prior art provides the technology to neutralize virtually ALL incoming threats. Every current ABM system depends on a "one-to-one" kill approach. In other words, one kill projectile is launched for every incoming assault missile.

The present invention discloses technologies intended to detect a missile launch using a unique analysis of ambient electromagnetic frequencies; therefore, additional related art includes airport radar matrix databases which are configured to trigger an alarm or alert condition when an "unexpected" or "out-of-range" object anomaly is detected.

The present invention also discloses technologies intended to neutralize the guidance systems of missiles and destroy the missile threat from a distance. Therefore, other technologies which must be considered relevant prior art are microwave, or other EM pulse transmitters such as may be related to Kremeyer's U.S. Pat. No. 6,527,221, which discloses a process in which a shock wave in a fluid is modified by emitting energy to form an extended path in the fluid.

Since no current ABM system has demonstrated 100% effectiveness at current "threat-to-kill" ratios, it is clearly unlikely that prior art can provide true missile defense security. The present invention provides improved capabilities to detect and neutralize single and multiple simultaneous missile threats.

SUMMARY AND OBJECTIVES OF THE INVENTION

The objective of the present invention is to provide the capability to detect and neutralize missiles in close proximity to the launch point. In today's volatile political climate, a system capable of detecting and neutralizing projectile borne weapons anywhere on the globe is critical to the defense of all nations.

Many systems are already being employed and developed for missile launch detection that take advantage of satellite mounted visual, and thermal detection systems, but these are only effective if they already happen to be pointing at potential threats. There are currently not enough airborne systems of this type to effectively cover the globe. The present invention may provide a solution to the problem of global missile launch detection.

Many years ago, the "Emergency Broadcast System" was established to use a network of all available broadcast transmitters to output a common "alert tone frequency" to warn the US population of a civil or military emergency. The present invention provides a unique and novel enhancement to this notification system. By creating a network of all available TV, radio, and telecommunications satellite and land based transmitters and receivers in all commercial and private spectra, and using precisely tuned electromagnetic frequency reading algorithms—operable on and through said network—a missile launch may be detected within moments of the initial fuel burn.

Another primary objective of the present invention is to provide a simplified multiple target tracking data format that allows rapid updating of the missile launch response section of the present invention.

Another primary objective of the present invention is to provide a missile neutralization system that disables or destroys the guidance system of a missile—or multiple missiles simultaneously—as well as any carried warheads, as close to the geographical launch point as possible. This is disclosed as a unique wide area missile threat neutralization system that utilizes a network of electromagnetic frequency pulses to disrupt the guidance systems of missiles after detection, create false target images, and disable or destroy the explosive materials within the warhead. Though there are numerous ways to adversely affect electrical devices remotely in prior art, no effective portable means has been available to stop the operational capabilities of missiles. The present invention disclosed herein may affect such results.

A more complete understanding of the present invention, as well as further features and advantages, will be obtained by reference to the following detailed description and drawings. Preferred embodiments of the present invention will be described in the dependent claims.

DETAILED DESCRIPTION OF THE INVENTION

Figure 1:
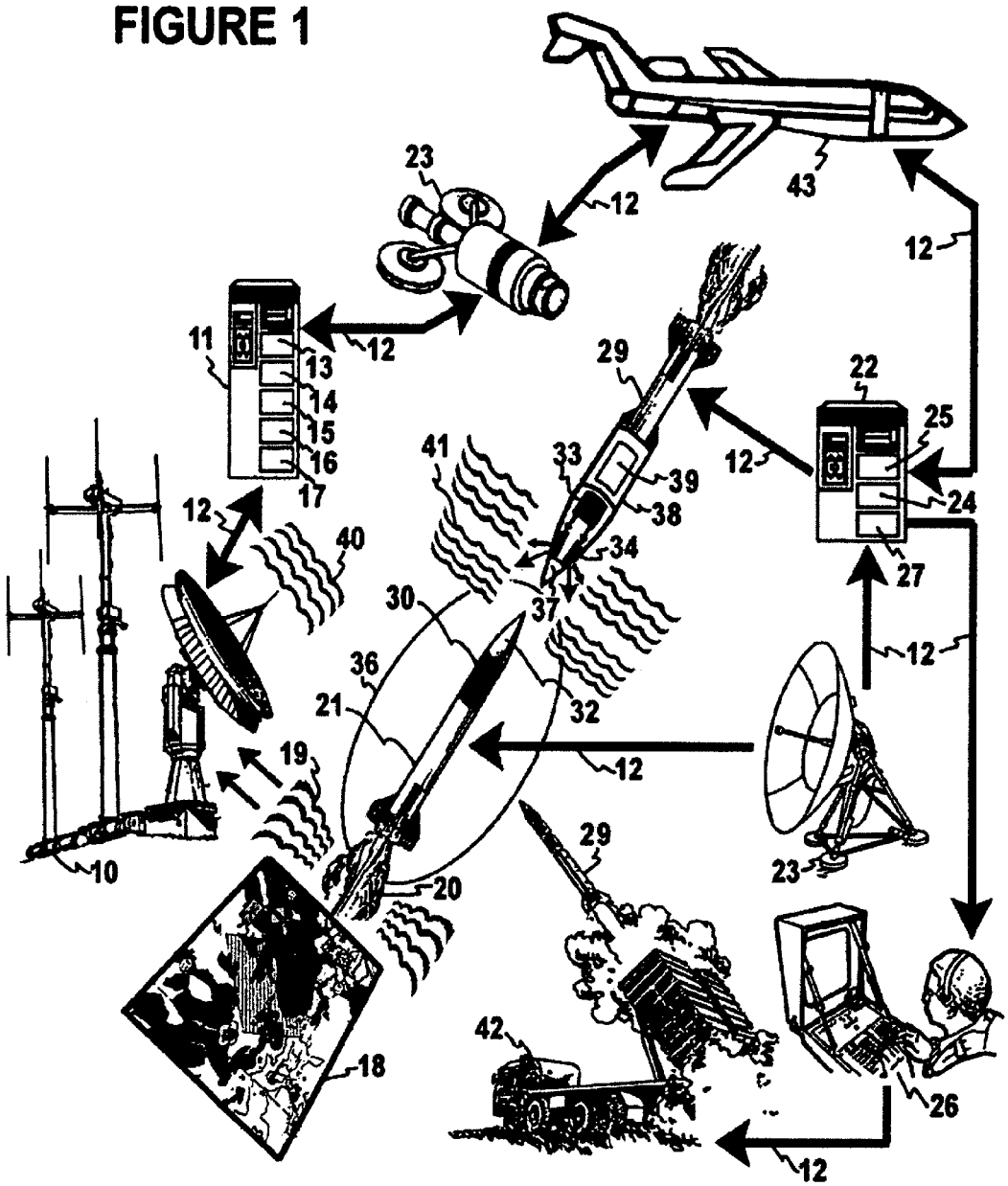
FIG. 1 is a schematic block diagram illustrating a missile detection and neutralization system per the present invention.

The primary objective of the present invention is to provide the capability to detect a missile launch anywhere on the globe within a fraction of a second after launch, and subsequently neutralize the guidance systems and warheads of said missiles before said missiles can destroy their intended target. There has been much discussion, both pro and con regarding the "Star Wars" missile defense system proposed during the Reagan administration. In this inventor's opinion, a missile defense system is absolutely necessary if there are missiles anywhere on the globe which can be launched by a rogue nation. However, since a laser or particle beam, space-based system will be extremely costly and—due to the nature of lasers—highly inefficient, it is only justifiable if it works precisely. Anyone who has attempted to hit a baseball with a bat when the baseball is thrown at speeds approaching a hundred miles an hour can attest to the difficulty of the task. Even the best ball players only hit well thrown pitches some of the time. Trying to hit multiple supersonic projectiles with space-based high powered laser or particle beam weapons—or even with multiple other supersonic projectiles simultaneously—is almost impossible. The present invention may provide a more functional and cost effective solution.

Many years ago, the "Emergency Broadcast System" was established to use a network of all available broadcast transmitters to output a common "alert tone frequency" to warn the US population of a civil or military emergency. The present invention provides a novel enhancement to this notification system and integrates it as a key component.

The preferred embodiment of a missile detection and neutralization system in accordance with the present invention, as shown in FIG. 1, combines a series of discreet subsystems including a broadcaster network 10, which is comprised of electronic communication links to telecommunications, TV, and radio satellite and land based transmitters and receivers, as well as airport radar systems in all commercial and private frequency spectra. A first computer processing system 11 is electrically coupled to said broadcaster network 10 through an electrical connection 12—which may be either wired or wireless—and said computer processing system 11 may incorporate a real time aberrant frequency targeting algorithm 13 coded to quantify and analyze all frequency wave data received and or transmitted by broadcaster network 10 in frequency usage database 15. Said analysis provides an "ambient frequency baseline matrix 14" drawn from the signal strength and amplitude characteristics of broadcaster network 10.

A missile threat identity authentication database 16 is also provided within computer processing system 11 as a look-up table to reference known missile launch electromagnetic data to said frequency usage database 15. Additionally, since weather conditions affect the ambient electromagnetic frequency spectrum, a "local area weather anomalies database 17", said data acquired through an electrical connection 12 links to weather service providers, is also incorporated within processing system 11 to further refine the ambient frequency baseline matrix 14 within processing system 11.

Aberrant frequency targeting algorithm 13 is configured that immediate confirmations of aberrant frequency disturbances can be identified and verified by processing system 11. The present invention effectively provides a global missile launch detection system that is capable of sensing a missile launch in any given geographical area 18 by "tagging" an out-of-range "electromagnetic wave disturbance 19" caused by the high intensity initial fuel burn 20 of a missile 21, and the subsequent continuing electromagnetic wave disturbance 19 of said missile 21.

By utilizing precisely tuned electromagnetic frequency reading algorithms within processing system 11—applied to the frequency data accessed through said broadcaster network 10—a missile launch may be detected within moments of the initial fuel burn. Aberrant frequency targeting algorithm 13 may be written in any computer language including C, C++, assembly, or other format capable of rapid database analysis and sorting. The details of the software code are not a limiting factor in the system design of the present invention, and therefore not necessary to describe in detail. This electromagnetic wave disturbance 19 activates the "response system 22" of the invention, which uses typical, and currently active prior art additional satellite or land based electromagnetic, visual, and/or thermal missile launch confirmation system 23 units—all linked to computer processing system 11 through electrical connection 12, to ultimately confirm or deny the missile launch.

The missile launch response system 22 may include a second computer processing system 24 to manage the electromagnetic wave disturbance 19 analysis output by Computer processing system 11 through electrical connection 12, and to catalogue said disturbance in a target tracking database 25.

The preferred embodiment of the missile tracking section of the present invention as shown in FIG. 1 would require that any confirmation system 23 unit, be oriented to observe a geographical area 18, as well as any missile 21 contained within geographical area 18 following an alert by processing system 11. All confirmation system 23 units would also be linked to processing system 24, which may be a standard computer configured to extract position information from a confirmation system 23 about the missile 21 locations within geographical area 18, and render said position information as a target data file 27. Processing system 24 may also be configured to digitize the colors, gestures, and angular orientation of said missile 21 within said geographical area 18 as elements of a data file 27. Second computer processing means 18 would also be linked to computer processing system 11 through electrical connection 12.

Another key component of the present invention is the format of target data file 27 that allows rapid updating of target tracking database 25. Said format may use a minimum of transmitted data to update the geographical location—in three dimensional space—of hundreds of missiles 23 simultaneously to the ambient frequency database computer processing system 11, which then activates a visual or thermal detection system 23.

The multiple target tracking data format for a target data file 27 specifications are as follows:

1. Each target location is represented in the x/y/z axes relative to a "zero" point on a three dimensional environment model mapped to a real world environment, provided at a resolution of ten CM over a range of twelve KM.

2. Each target's location in the x, y, and z axes is mapped to the environmental model with the same resolution of ten CM over a range of twelve KM, using two bytes (sixteen bits) per axis.

3. Each target is identified with a one byte ID tag. The target locations are updated at least thirty times per second with a global four byte time stamp.

5. Target data is available in real time and as a recorded data file.

6. An array of statistical outputs from the target data can be extrapolated including;

a. trajectory lines of targets through the environmental model.

b. acceleration/deceleration of targets over time.

c. speed over time.

d. g-forces at vector change.

7. CRC (error correction) codes are added.

8. As an example of efficiency, this format may allow approximately forty-five simultaneous target positions to be streamed at under fifty-six K.

Multiple visual or thermal detection system 23 units may receive a target tracking signal 28 from missile launch response system 22. Where there is a danger of multiple ballistic missiles being launched toward the United States, designated signal processing units coupled to computer processing systems 11 and 24 through electrical connection 12, can be configured to receive a tracking signal 28 which is specific to a particular type of ballistic missile or to a pre-selected geographic region from which a ballistic missile launch is detected. Alternatively, certain signal processing units may be configured to receive a tracking signal indicative of a ballistic missile launch location and to produce an intercept trajectory—all programmed to guide a defensive missile 29 to the ballistic missile 21 launch site, while other signal processing units may be configured to produce an intercept trajectory program.

A key problem that the United States, or any other country, faces from a missile borne threat, is the difficulty in determining with certainty the final trajectory of a missile once it's been launched. If a missile is outfitted with a state-of-the art "threat reactive" guidance system, most current trajectory analysis technology will fail. These guidance systems can be programmed to sense the presence of an incoming "anti-missile" threat, and change course temporarily for evasive maneuvers. The most effective way to neutralize this capability is to disable the on-board computer guidance system 30 of a missile 21 so that a fixed trajectory 31 can then be established and determined, and an anti-ballistic missile 29—as disclosed herein as an interceptor missile armed with wide area electromagnetic transmission and/or concussion burst capability—or another prior art neutralization system 42 enabled. Neutralization system 42 may be a satellite borne laser, microwave or other electromagnetic pulse, a particle beam generator, anti-ballistic missile, or a combination of these, and may used to launch a defensive missile 29.

Land launched "kill vehicles", intended to intercept an incoming ballistic missile in midcourse represent the choice of the USDoD for the National Missile Defense ("NMD" ) system, however, such a system provides less time to evaluate the trajectory of the incoming ballistic missile than a final phase trajectory trisection system, such as the one disclosed in the Millard patent. Alternatively, such a system provides more time to evaluate the trajectory of the incoming ballistic missile than an initial phase trajectory trisection system.

The only truly failsafe missile shield is a system capable of effectively disabling the missile guidance systems—thereby defining an observable, stable trajectory for each projectile—and subsequently neutralizing or triggering the onboard ordinance and/or warheads, and rendering the missiles useless. Assuming multiple missiles are fired simultaneously, it is necessary to destroy or disable the ordinance components of ALL the missiles for a "missile shield" to be truly successful.

The present invention discloses a unique wide area missile threat neutralization system that utilizes a network of electromagnetic frequency pulses—which may be partially output by broadcaster network 10, to disrupt the guidance system of a missile 21 after detection by a detection system 23 unit, and create false target images, and/or disable or destroy the explosive materials within a warhead 32 of a missile 21. Additionally, the present invention may provide a missile neutralization system intended to disable or destroy a missile and its warhead close to the geographical launch point.

Electrical circuit destabilizing effects resulting from "voltage burst" devices are well known. Many product testing agencies use cattle prods to stress electrical circuitry to the point of destruction. Applying static electricity to a sensitive integrated circuit can have similar results. Paniagua's U.S. Pat. No. 3,971,292 describes a double-barreled pistol for simultaneously projecting two, continuous, parallel streams of conductive fluid to kill or stun prey. Coakley, et al's U.S. Pat. No. 5,625,525 also describes a device and method for stunning a human or other living animal by employing a nozzle or other such means through which a conductive fluid stream can be discharged toward the living animal.

In order to shut down the guidance circuitry of a missile, it is necessary to disrupt or overload the "intelligent" portions of the circuitry. Low voltage, low current integrated circuits (ICs) and central processing units (CPUs) are integral parts of all guidance systems. These ICs and CPUs can be destroyed with DC, AC, and/or static electrical charges of the correct voltage, frequency, and current makeup.

The present invention discloses two discrete systems intended to neutralize a missile threat. They may be effective individually or when used in combination. FIG. 2 is a schematic diagram of an apparatus comprised of a high voltage, high current, and/or high frequency electrical discharge means deployed from a projectile, which may disperse conductive media within and around a missile 21 shell, to create a dispersed "lightning" effect, to disrupt the electron flow in the IC and CPU components. This may be used to create false target images, and/or interrupt or destroy the missile 21 guidance system 30, and then allow for the broad distribution of a tailored electromagnetic frequency pulse and/or deactivate the triggering system of a warhead 32.

The embodiment of the present invention as illustrated in FIG. 1 is intended to create negative or positive electrostatic or electromagnetic polarization in a solid, liquid, or gaseous medium, augmented by an electrically destructive frequency burst. An anti-ballistic missile 29 is provided. One or more frequency generators 33 are mechanically located inside missile 29, and electrically coupled to one or more transducer/antennae arrays 47. An "active natural resonant" frequency data set for any given guidance system 30 or warhead 32 is provided that may induce desired atomic or molecular component polarization effects in a surrounding medium 36, and is preloaded into one or more frequency generators 33.

Those frequency waves that are most absorbed by the electrical components in a guidance system 30 or a warhead 32 may be considered the "active natural resonance" fundamental frequencies of said devices. Said frequencies must initially be identified through laboratory experimentation and are then integrated within frequency generator 33, which may be capable of outputting precisely tuned electrostatic and electromagnetic waves emulating those that are generated and radiated during a nuclear explosion.

For any guidance system 30 or warhead 32, there is a "key" fundamental active natural resonance frequency which may be applied by frequency generator 33 to catalyze destruction of the electronic components. Initially altering a single specific molecular or atomic structure within a guidance system 30 or warhead 32, and concurrently altering the ensuing applied frequencies, may then propagate state changes in all the associated structures. For example, if a molecule of a given component is comprised of ten atomic elements arranged in a particular way, modifying the polarity of the third most abundant atomic element in the molecule will have a different effect than modifying the first most abundant—and vice versa.

Frequency Generator 33 is capable of generating single or multiple frequency waves from DC to gigahertz ranges and above—combined with single or multiple harmonics, inversions, and dissonances in said frequency ranges at variable amplitudes. The resultant frequency waves 41 are projected by transducer/antennae array 34 at given points in space in any surrounding medium 36. Said transducer/antennae array 34 is electrically coupled to frequency generator 33, and mechanically coupled to the shell of defensive missile 29.

A catalytic fluid or gaseous media may also be used to initiate a chain reaction of desired effect. Antiballistic missile 29 may be loaded with an electrically conductive fluid 37 which is dispersed in the area of a target missile 21 to create a conductive matrix to allow a "focused lightning effect" to conduct the key frequencies output by frequency generator 33 to the guidance system circuitry of a missile 21, which generally operates at low DC voltages and current. By overdriving the sensitive integrated circuits in the guidance system and possibly the warhead detonator with a flood of precisely tuned electrical spikes, results may range from a temporary disruption of the vehicle guidance system 30, to total destruction of the onboard warhead 32.

A secondary stage 38 of missile 29 may be provided, and configured with an explosive concussion warhead 39 designed to trigger any missile 21 borne warheads within a wide area from a distance. This enables the simultaneous destruction of multiple missiles 23. After a guidance system 30 and/or a warhead 32 is disabled—a missile 21 may then be rendered mechanically non-functional with said stage 38.

Kremeyer's U.S. Pat. No. 6,527,221 discloses a process in which a shock wave in a fluid is modified by emitting energy to form an extended path in the fluid; heating fluid along the path to form a volume of heated fluid expanding outwardly from the path; and directing a path. The volume of heated fluid passes through the shock wave and modifies the shock wave. This allows for the transmission of a destructive EM pulse—tuned by the capabilities disclosed in the present invention—to destroy an incoming missile threat.

Those frequencies that are absorbed by a surrounding medium 36 are its "active natural resonance" fundamental frequencies. "Overdriving" the amplitude of said frequencies with respect to the base rate of absorption may result in the ionization, and therefore affect the electrical conductivity, of surrounding medium 36. For any surrounding medium 36, there is a "key" fundamental active natural resonance frequency which may then be manipulated and augmented by the addition of frequency inversions, harmonics, dissonance, and offsets of said "overdriving" frequencies, to said overdriving frequencies, to induce an electrical discharge.

In the context of the present invention as illustrated in FIG. 1, Computer processing system 11 may be configured to direct broadcaster network 10—and Multiple visual or thermal detection system 23 units may be directed by missile launch response system 22—to transmit specific electromagnetic and electrostatic frequency pulses 40—as defined by additional coding in aberrant frequency targeting algorithm 13, toward multiple geographical areas 18, or a surrounding medium 36 independently or simultaneously, to enhance negative or positive electrostatic or electromagnetic, polarization waves 41—augmented by a frequency burst destructive to electrical components—in a solid, liquid, or gaseous medium surrounding medium 36 (which may be the atmosphere) through which a missile 21 is traversing. Said frequencies may be designed to ionize the surrounding medium 36 around said missile 21 launch, and alter the electrical conductivity of said surrounding medium 36, to destroy or disable a guidance system 30 and/or a warhead 32, and/or to optimize the effectiveness of frequency generator 37, borne by a defensive missile 29. The effects of said frequency pulses 40 may also be to distract, disable, and/or destroy said launched missile 21 threat.

An additional objective of the invention as detailed in FIG. 1 is to provide protection for a commercial aircraft 43. Said aircraft 43 may be wirelessly linked to broadcaster network 10 and missile response system 22. In the event of a missile 21 threat aimed at aircraft 43, a defensive missile 29 may be launched from aircraft 43. Further, a frequency Generator 33 and transducer/antennae array 34 combination may be integrated into the avionics package within aircraft 43 to project a frequency polarization wave 41 at given points in space to affect the guidance system and warhead of a missile 21.

It is to be understood that the embodiments and variations shown and described herein are merely illustrative of the principles of this invention and that various modifications may be implemented by those skilled in the art without departing from the scope and spirit of the invention.

I claim:

1. A missile detection and neutralization system comprising;

a first computer program product, said computer program residing on a computer readable medium, and configured to classify and analyze electromagnetic frequencies transmitted or received by satellite or land based commercial and private broadcast and telecommunications means;

a second computer program product, said second computer program also residing on said computer readable medium, and configured to classify and analyze weather conditions in at least one geographical area; and a third computer program product, said third computer program also residing on said computer readable medium, and configured to detect from said weather and frequency classification and analysis functions, the position of a missile launched within said geographical area by targeting the electromagnetic frequency disturbance caused by the fuel burn of said missile, and the ensuing electromagnetic frequency aberrations resulting from the atmospheric disturbance caused by said missile.

2. A missile detection and neutralization system according to claim 1 that includes;

hardware means configured to classify and analyze electromagnetic frequencies transmitted or received by satellite or land based commercial and private broadcast and telecommunications means, and configured to classify and analyze weather conditions in at least one geographical area, and configured to detect from said weather and frequency classification and analysis functions, the position of a missile launched within said geographical area by targeting the electromagnetic frequency disturbance caused by the fuel bum of said missile, and the ensuing electromagnetic frequency aberrations resulting from the atmospheric disturbance caused by said missile.

3. A missile detection and neutralization system according to claim 1 that includes at least one missile launch confirmation means capable of targeting said launched missile after detection, and defining an accurate trajectory for said launched missile.

4. A missile detection and neutralization system according to claim 1 that includes at least one means to create an ionized, or other electrically conductive path through the air or fluid medium that said missile is traversing.

5. A missile detection and neutralization system according to claim 1 that includes at least one means to transmit a precisely tuned electromagnetic frequency pulse configured to interrupt or destroy a missile guidance system, or detonate said missile's fuel source, or deactivate the triggering system of the warhead carried by said missile.

6. A missile detection and neutralization system according to claim 1 that includes a frequency transmission means configured to affect the molecular structure within a missile guidance system or warhead detonator by transmitting at least one frequency wave combination, wherein said frequency wave combination is configured by the addition or subtraction of at least one second frequency wave amplification, harmonic, dissonance, inversion, or an offset of at least one first frequency wave to or from said first frequency wave.

7. A missile detection and neutralization system according to claim 1 that includes a target location data file configured as follows:

each target location is represented in the x/y/z axes relative to a "zero" point on a three dimensional environment software model that matches at least one real world environment, provided at a resolution of ten CM over a variable range of KM;

each target's location in the x, y, and z axes is mapped to said environmental model with the same resolution of CM over a range of twelve KM, using two bytes per axis;

each target is identified with a one byte ID tag, the target locations are updated at least thirty times per second with a global four byte time stamp, with CRC codes added; and target data is available in real time and as a recorded data file, and an array of statistical outputs from the target data are configured to be extrapolated including:

a. trajectory lines of targets through the environmental model;

b. acceleration/deceleration of targets over time;

c. speed over time;

d. g-forces at vector change.

8. A missile detection and neutralization system that includes means to create an ionized or other electrically conductive path through the air or fluid medium that a missile is traversing, comprising:

means for generating at least one frequency wave combination, wherein said frequency wave combination is configured by the addition or subtraction of at least one second frequency wave amplification, harmonic, dissonance, inversion, or offset of at least one first frequency wave to or from said first frequency wave; and means for transmitting at least one frequency wave combination, wherein said frequency wave combination is configured by the addition or subtraction of at least one second frequency wave amplification, harmonic, dissonance, inversion, or offset of at least one first frequency wave to or from said first frequency wave.

9. A missile detection and neutralization system that includes means to transmit a precisely tuned electromagnetic pulse configured to interrupt or destroy a missile guidance system, or detonate said missile's fuel source, or deactivate the triggering system of the warhead carried by said missile, comprising:

means for generating at least one frequency wave combination, wherein said frequency wave combination is configured by the addition or subtraction of at least one second frequency wave amplification, harmonic, dissonance, inversion, or offset of at least one first frequency wave to or from said first frequency wave; and means for transmitting at least one frequency wave combination, wherein said frequency wave combination is configured by the addition or subtraction of at least one second frequency wave amplification, harmonic, dissonance, inversion, or offset of at least one first frequency wave to or from said first frequency wave.

* * * * *